US006695680B2

(12) United States Patent
Choi et al.

(10) Patent No.: US 6,695,680 B2
(45) Date of Patent: Feb. 24, 2004

(54) POLISHING PAD CONDITIONER FOR SEMICONDUCTOR POLISHING APPARATUS AND METHOD OF MONITORING THE SAME

(75) Inventors: Jae Hoon Choi, Gyeonggi-Do (KR); Bong Choi, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/183,655

(22) Filed: Jun. 28, 2002

(65) Prior Publication Data

US 2003/0013394 A1 Jan. 16, 2003

(30) Foreign Application Priority Data

Jun. 29, 2001 (KR) ..... 10-2001-0038481

(51) Int. Cl.[7] ..... B24B 1/00

(52) U.S. Cl. ..... 451/5; 451/7; 451/56; 451/285; 451/287; 451/443

(58) Field of Search ..... 451/56, 6, 7, 5, 451/21, 60, 285–289, 443, 444

(56) References Cited

U.S. PATENT DOCUMENTS 5,456,627 A * 10/1995 Jackson et al. ..... 451/11
5,531,635 A * 7/1996 Mogi et al. ..... 451/72
5,827,112 A * 10/1998 Ball ..... 451/21
5,975,994 A * 11/1999 Sandhu et al. ..... 451/56
6,083,085 A * 7/2000 Lankford ..... 451/56
6,220,936 B1 * 4/2001 Quek ..... 451/41
6,306,008 B1 * 10/2001 Moore ..... 451/5
6,364,752 B1 * 4/2002 Kimura et al. ..... 451/56
6,390,895 B1 * 5/2002 Katagiri et al. ..... 451/56
6,572,440 B2 * 6/2003 Moore ..... 451/5

* cited by examiner

*Primary Examiner*—George Nguyen
(74) *Attorney, Agent, or Firm*—Volentine Francos, PLLC

(57) ABSTRACT

The operation of a polishing pad conditioner for a CMP apparatus is monitored. The polishing pad conditioner includes a housing, a first drive pulley disposed in the housing and connected to a motor at a first side of the housing, a conditioning head having a diamond disk for conditioning the polishing pad and mounted to a second side of the housing, a second pulley coupled to the conditioning head for transferring the driving force from the drive pulley to the conditioning head, a timing belt engaged with the first and second pulleys, an air supply tube for supplying air under pressure to the conditoner head to force the head against a polishing pad of the CMP apparatus, and at least one sensor disposed in the housing for sensing the operation of the conditioning head.

10 Claims, 5 Drawing Sheets

POLISHING PAD CONDITIONER FOR SEMICONDUCTOR POLISHING APPARATUS AND METHOD OF MONITORING THE SAME

BACKGROUND OF THE INVENTION

1. Field of the Invention

The present invention relates to chemical mechanical polishing (CMP). More particularly, the present invention relates to a pad conditioner of a semiconductor chemical mechanical polishing apparatus.

2. Description of the Related Art

In general, many layers such as semiconductor layers, insulation layers, and conductive layers must be formed on a semiconductor substrate to fabricate a semiconductor device. In addition, the surfaces of these layers must often be planarized on the semiconductor substrate. A chemical mechanical polishing (CMP) process is predominantly used in semiconductor device fabrication for planarizing such surfaces on a semiconductor substrate.

To perform the CMP process, a semiconductor substrate known as a wafer is transferred to a rotating polishing pad and an abrasive slurry is applied between the wafer and the polishing pad. The slurry causes a chemical reaction with the surface of the wafer. Also, the surface of the wafer is pressed against the rotating polishing pad, whereby the wafer is mechanically polished. As a result of these chemical and mechanical workings, the surface on the semiconductor substrate is planarized.

The polishing pad must have a uniform surface roughness to provide the desired polishing rate. Over time, however, the polishing process glazes the polishing pad and creates irregularities in the polishing pad. Accordingly, the polishing pad surface is typically conditioned by a pad conditioner to deglaze the surface of the polishing pad, whereby surface irregularities are removed and the slurry is capable of spreading uniformly across the polishing pad.

The pad conditioner typically consists of a conditioning head having a diamond disk with a roughened surface, a rotary actuating device for rotating the conditioning head, and a linear actuating device for driving the conditioning head up and down. First, the conditioning head is moved onto the polishing pad. And then the conditioning head is rotated against the polishing pad while being forced downwardly by the actuating devices, thereby conditioning the polishing pad.

In the conventional pad conditioner, the rotary actuating device includes a timing belt and a motor for driving the timing belt, and the linear actuating devices includes air supply tubing and a source of compressed air for forcing air through the tubing. However, over time, the timing belt becomes worn out or torn at a portion thereof with a pulley. When these problems occur, the rotational force can not be transferred to the conditioning head from the motor. Furthermore, the air supply tubing gradually degrades to the point where air begins to leak therefrom, especially at a joint of the tubing. In this case, sufficient air pressure can not be produced to move the conditioning head vertically.

In any case, pad conditioning can not be performed uniformly and normally when the timing belt or the air supply tubing is damaged. At the very least, damage to the timing belt or air supply tubing increases the time required for conditioning the polishing pad. Such damage also may produce particles that migrate onto the polishing pad, and thereby ultimately causing scratches on the semiconductor substrate surface.

Accordingly, the ability to test the timing belt and air supply tubing of the conditioning pad for signs of damage would be highly desirable.

SUMMARY OF THE INVENTION

Therefore, an object of the present invention is to provide a pad conditioner which is capable of monitoring itself for damage, whereby the conditioning rate and efficiency of the pad conditioner can be maintained.

According to one aspect of the present invention, a pad conditioner includes a housing, a conditioning head having a diamond disk for conditioning a polishing pad and mounted to the housing so as to be roatable and vertically movable relative to the housing, a transmission mechanism for transmitting a drive force from a motor to the conditioning head to rotate the conditioning head, an air supply system for supplying air pressure that moves the conditioning head vertically so that it can be forced against a polishing pad, and at leat one sensor for sensing the rotational speed of the conditioning head and/or the pressure of air being delivered to the conditioning head.

The transmission mechanism includes a first (drive) pulley which is rotated by a motor mounted to the housing, a second (driven) pulley connected to the conditioning head by a shaft, and a timing belt reeved around the first pulley and the second pulley. Preferably, the sensor is a rotation sensor installed near the second pulley and detecting the state of rotation of the conditioning head by sensing the rotational speed of the second pulley. The rotation sensor can be a flag sensor or an optical sensor.

The air supply system includes an air supply tube extending through said housing and through which air is supplied to the conditioning head. The sensor may thus be a pressure sensor installed on the air supply tube.

According to another aspect of the present invention, the operation of the polishing pad conditioner is monitored as follows. The conditioning head is first into contact with the polishing pad of a CMP apparatus. Then, the conditioning head is forced against the polishing pad with a certain pressure. While the conditioning head is forced against the polishing pad, the conditioning head is rotated by driving a transmission element coupled to the conditioning head.

Next, the pressure used to force the conditioning head against the polishing pad and/or the rate at which the transmission element is driven is/are sensed. The value of the sensed pressure and/or rate is/are compared to a corresponding value(s) representative of a normal operation of the polishing pad conditioner.

BRIEF DESCRIPTION OF THE DRAWINGS

These and other objects, features, and advantages of the present invention will become apparent from the following detailed description of the preferred embodiments of the present invention, made in conjunction with the accompanying drawings, of which.

DETAILED DESCRIPTION OF THE PREFERRED EMBODIMENTS

Figure 1:
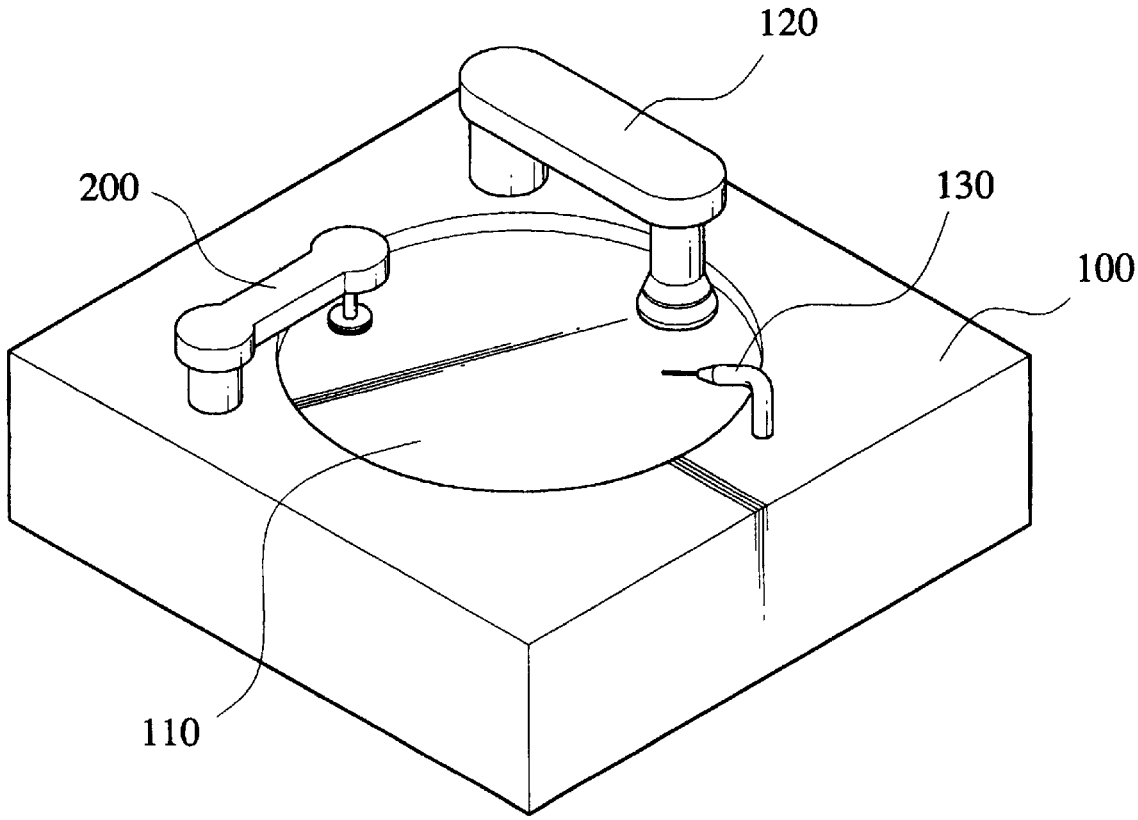
FIG. 1 is a perspective view of a chemical mechanical polishing apparatus in accordance with the present invention.

As shown in FIG. 1, a CMP apparatus includes a base 100 having a recess therein, and a polishing pad 110 received in the recess. A wafer carrier 120 is pivotally mounted to the base 100, and a pad conditioner 200 and a slurry tube 130 are also mounted to the base 100.

Figure 2:
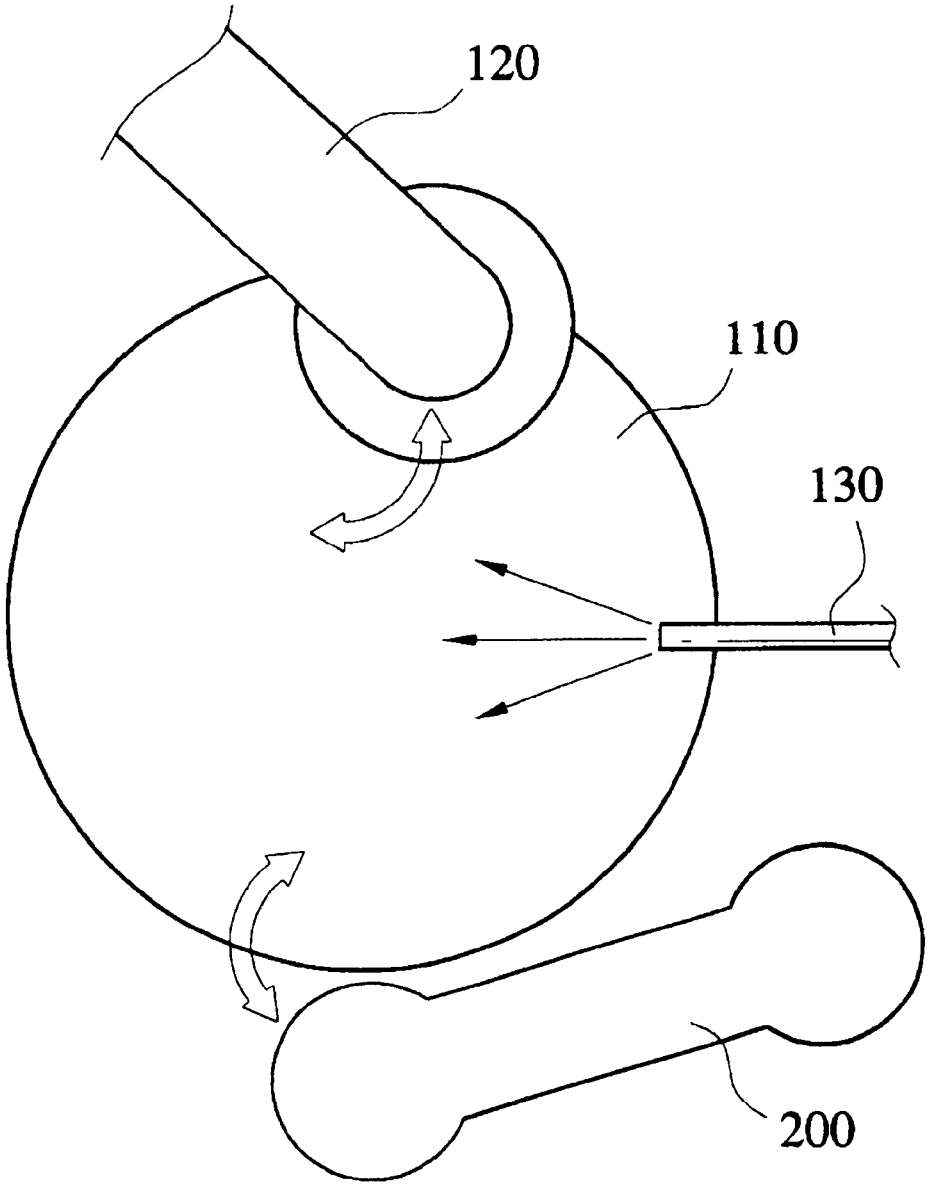
FIG. 2 is a plan view of part of the CMP apparatus, illustrating the operation of the same in accordance with the present invention.

As shown in FIG. 2, the wafer carrier 120 moves over the polishing pad 110 while supporting a wafer at the bottom surface thereof. Slurry is emitted form the slurry tube 130 onto the polishing pad 110 and is thereby distributed between the polishing pad 110 and the wafer. The top surface of the wafer is thus placed in contact with the polishing pad 110. Then, the wafer carrier 120 is rotated and moved up and down, whereby the wafer is polished. At this time, the pad conditioner 200 is placed on the polishing pad, whereupon the polishing pad 110 is conditioned.

Figure 3:
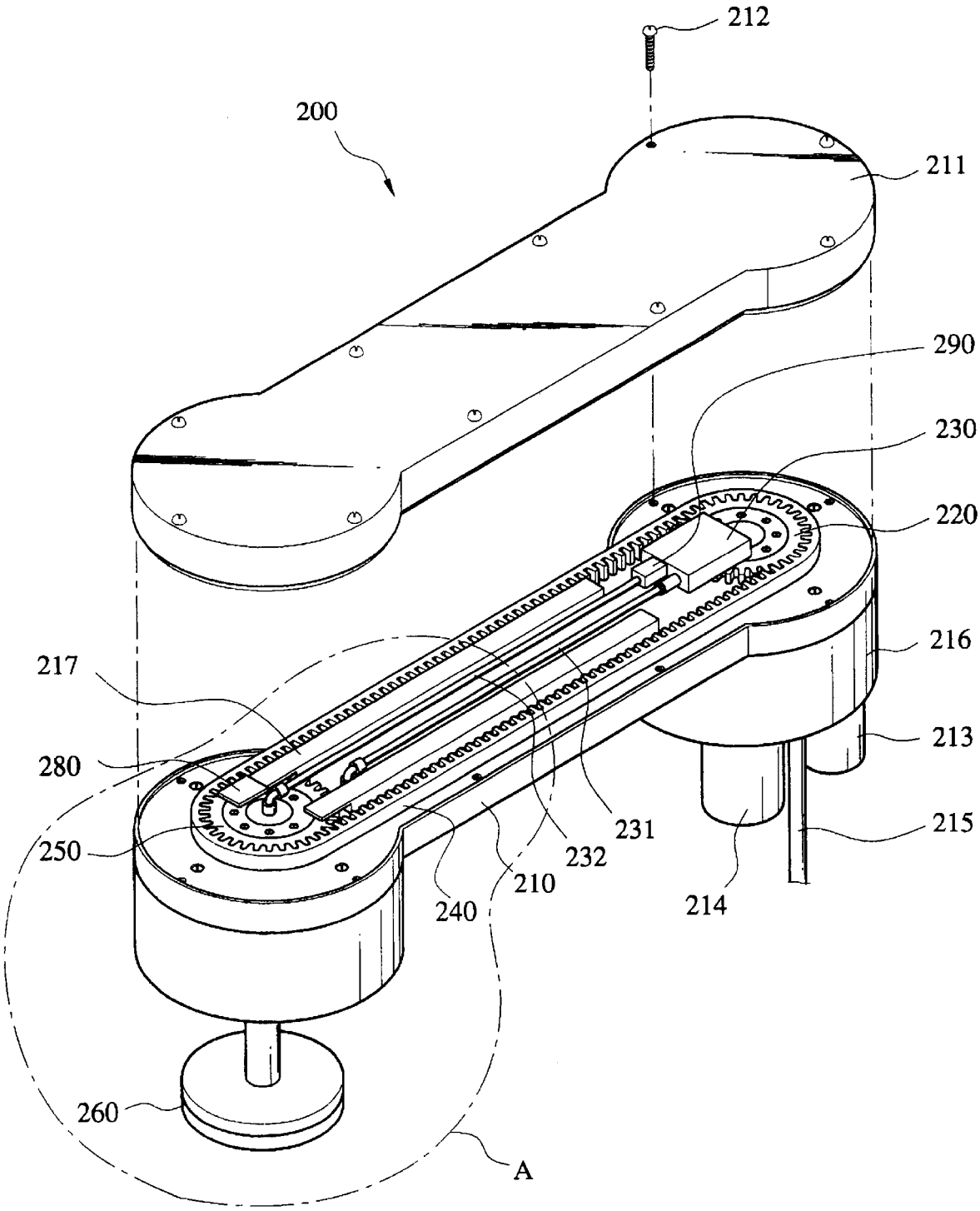
FIG. 3 is a an exploded perspective view of a pad conditioner in accordance with the present invention.

FIG. 3 shows the pad conditioner 200 in detail. The pad conditioner 200 includes a housing 210 having two ends, namely, a first end and a second end, and a cover 211 secured to the housing 210 with bolts for covering the housing 210. The housing 210 is pivotally connected to the base body 100 by means of a shaft disposed at the first end of the housing 210. A lower part of the first end of the housing 210 supports a rotating motor 213 for rotating the pad conditioner 200 on the polishing pad and a swing motor 214 for oscillating the housing 210 between the base 100 and the polishing pad 110. An air supply tube 215 is externally connected to the first end of the housing 210.

A gear box 216 having gears (not shown) is provided over the rotating motor 213 and the swing motor 214 to transmit the driving forces supplied by the motors 213 and 214. A first pulley 220 rotated by a rotating motor 213 and an air pressure controller 230 are disposed in an upper part of the first end of the housing 210. A second pulley 250 is disposed in the second end of the housing 210. A timing belt 240 is wrapped around and engaged with the first pulley 220 and the second pulley 250, so that the timing belt 240 is driven in association with the rotation of the first pulley 220 to transfer a rotary drive force to the second pulley 250.

An air supply tube 232 and an air recovery tube 231 are connected to the air pressure controller 230 and extend longitudinally along the upper part of the housing 210 between the first and second ends thereof Furthermore, the air supply tube 232 extends into a hole formed through the second end of the housing 210 at the center portion thereof.

A conditioning head 260 having a diamond abrasive disk is mounted to the bottom of the second end of the housing 210 and is rotatably connected thereto by means of a shaft.

Two supporting rods 217 extend between the first end and the second end of the housing 210 at the upper part of the housing 210. A rotation sensor 280 is mounted to one end of the supporting rod 217 near the second pulley 250, so that the rotation sensor 280 senses the rotational speed of the second pulley 250. A pressure sensor 290 is connected to the air supplying tube 232 near the air pressure controller 230.

Figure 4:
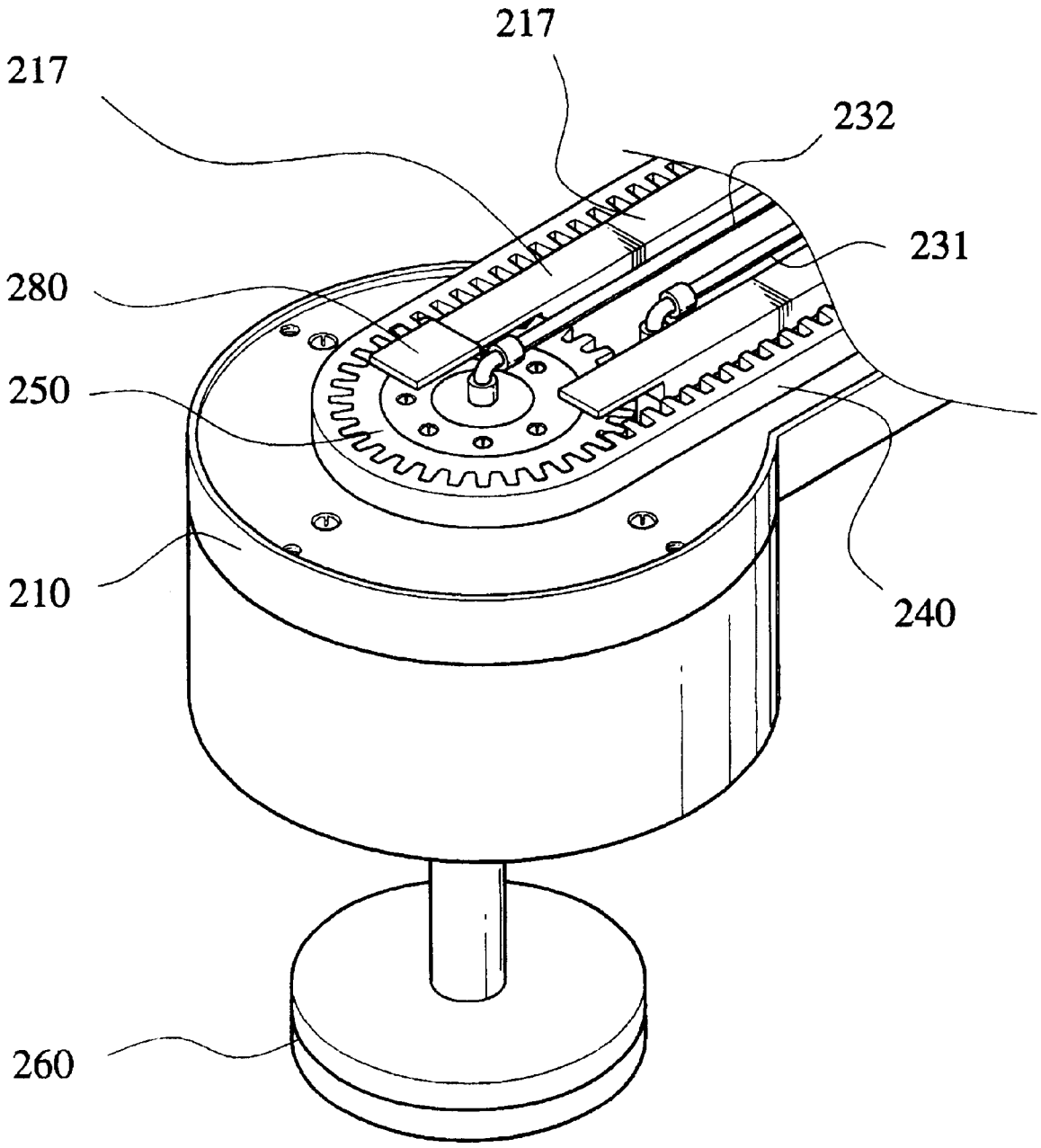
FIG. 4 is an enlarged perspective view of part A of the pad conditioner illustrated in FIG. 3, in accordance with the present invention.

Referring now to FIG. 4, the rotation sensor 280 is used to check whether the conditioning head 260 is rotating at a predetermined speed, i.e., at a certain number of revolutions per minute (RPMs). To this end, the rotation sensor 280 is a flag sensor. Alternatively, the rotation sensor 280 can be an optical sensor. Also, although the rotation sensor 280 has been shown and described as being disposed adjacent the second pulley 250 for sensing the rotational speed thereof, the rotation sensor 280 can instead be mounted to directly sense the rotational speed of the first pulley 220 or the speed at which the timing belt 240 is driven. However, sensing the rotational speed of the second pulley 250 is preferable because the second pulley 250 is the last of the transmission elements to receive rotational force from the motor 213; accordingly, the rotation sensor 280 can best detect the operation of the timing belt 240 that transmits such a force to the second pulley, thereby providing a reliable sensing operation. In other words, abnormal rotation of the conditioning head 260 can be detected sensitively, quickly and accurately because the second pulley 250 is located at the last stage of the transmission for transferring rotational force to the conditioning head 260.

The pressure sensor 290 is used to check whether air is flowing normally through the air supply tube 232, i.e., at a predetermined pressure. The pressure sensor 290 thus essentially tests the up and down movement of the conditioning head 260.

The polishing pad 110 is conditioned by the pad conditioner 200 while the polishing pad 110 polishes a wafer which is mounted on carrier head 120 (shown in FIG. 2). To begin the conditioning process, the conditioning head 260 is moved over the polishing pad 110 by the swing motor 214. The conditioning head 260 sweeps across polishing pad 110 with a motion that is synchronized with the motion of carrier head 120 across polishing pad 110. The conditioning head 260 is rotated by the rotating motor 213 while abutting the polishing pad 110. Also, air pressure is applied to the conditioning head 260 from the external air supply tube 215 as the conditioning head 260 is being rotated.

The conditioning head 260 is rotated as follows. First, the rotational force from the rotating motor 213 is applied to the first pulley 220 through the gear box 216. Then, the first pulley 220 is rotated and the timing belt 240 engaged with the first pulley 220 is driven. Thus, the second pulley 250 is rotated by the timing belt 240. On the other hand, the conditioning head 260 is moved up or down as follows. Air supplied though the external air supply tube 215 is transferred to the air supply tube 232 by way of the air pressure controlling device 230. The air from the air supply tube 232 applies pressure against the conditioning head 260 to force the conditioning head 260 downward and thereby maintain the conditioning head 260 against the polishing pad 110. When the conditioning process is completed, the air pressure applied to the conditioning head 260 is relieved through the air recovering tube 231, whereupon the conditioning head 260 is moved upward by means of a retracting mechanism (not shown) such as a spring. Furthermore, the rotating motor 213 stops operating at this time.

Figure 5:
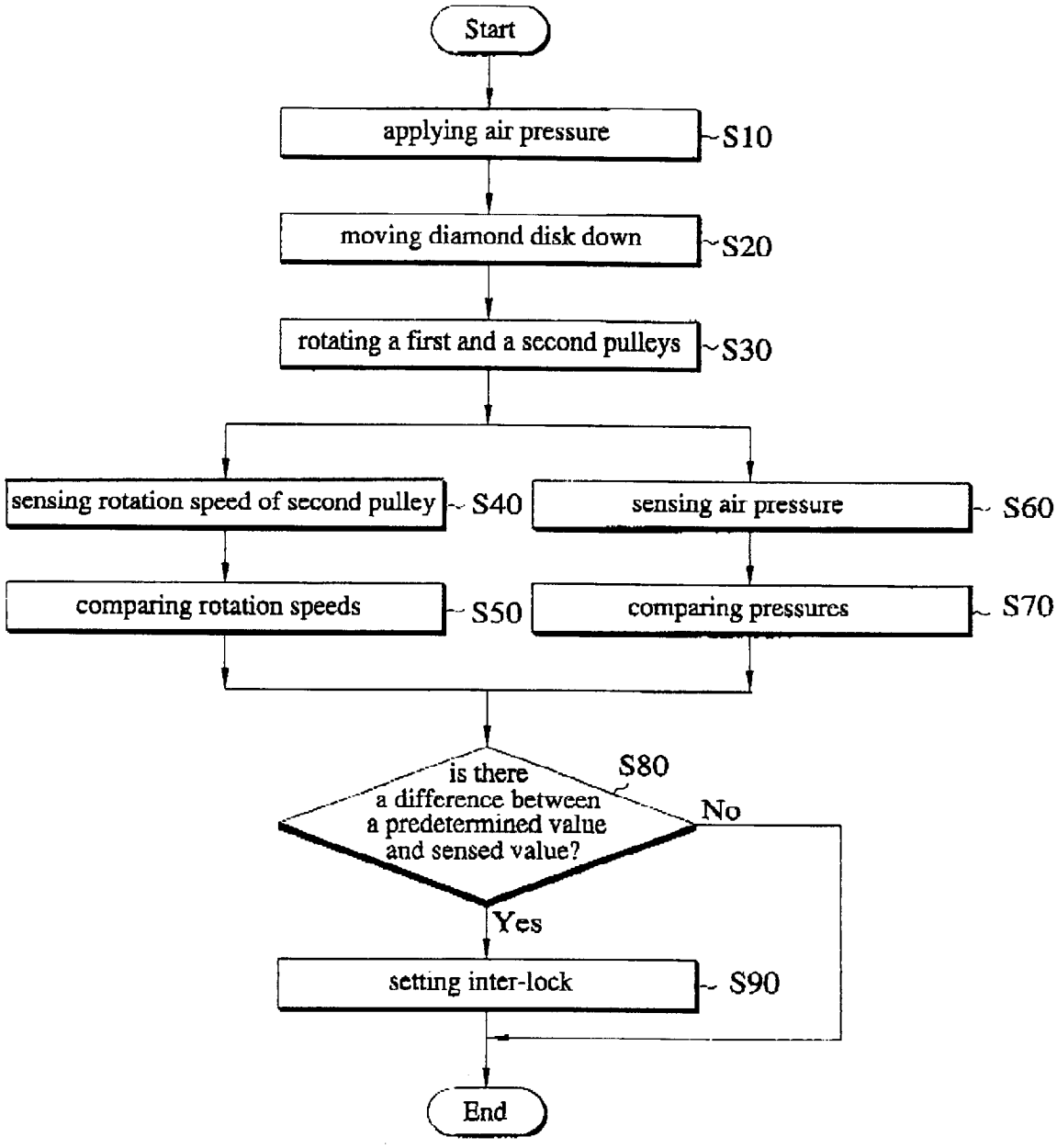
FIG. 5 is a flow chart showing the operation of the pad conditioner in accordance with the present invention.

The rotation sensor 280 and the pressure sensor 290 test whether the rotation and up and down movement of the conditioning head 260 are normal. Referring now to FIG. 5, air pressure is applied to the conditioning head through the external air supply tube 215, gears of the air pressure controller 230 and the air supply tube 232 (S10). Once the air produces a certain level of pressure, the diamond disk of the conditioning head 260 is driven downward into contact with the polishing pad 110 (S20). Subsequently, the operation of the rotating motor 213 is initiated such that a driving force is transferred from the first pulley 220 to the timing belt 240. Therefore, the second pulley 250 engaged with the timing belt 240 is rotated, so that the conditioning head 260 begins to rotate and condition the polishing pad 110 (S30).

Next, during the conditioning process, the rotation sensor 280 senses the rotational speed of one of the transmission elements, preferably, the second pulley 250 which is the last element in the chain of transmission elements (S40). The value of the sensed rotational speed is compared with a predetermined rotating speed value (S50). At the same time, the pressure sensor 290 senses the pressure of the air within the air supply tube 232 at predetermined intervals (S60), and a value of the sensed pressure is compared with a predetermined pressure value (S70).

The steps of S40–S70 are carried out continuously until a difference occurs between a sensed value and the corresponding predetermined value (S80). In the case in which such a difference occurs, the CMP apparatus is inter-locked (S90) and the CMP process stops because the sensing operation is indicative of an abnormal operation of the conditioning head. If an abnormal operation is detected, a technician can take appropriate action to obviate the problem or problems causing the abnormal operation.

The abnormal operation of the conditioning head 260 could be a sign that that (1) the rotating motor 213, the gear box 216, the first pulley 220, and/or the second pulley 250 are damaged (2) that the timing belt 240 is worn out or torn and/or (3) that the air supply system is malfunctioning or that one of the tubes has a perforation or has become dislodged. In fact, most cases of abnormal operation due to low air pressure are the result of a leak in the external air supply tube 215. In that case, a technician can locate the leak and then simply repair the external air supply tube 215.

As alternatives to the embodiments described above, the rotation sensor and the pressure sensor can be separately or selectively operated instead of being operated continuously together. Also, more than one rotation sensor and/or more than one pressure sensor can be provided so that an abnormal operation of the CMP apparatus can be even more quickly sensed and the root cause thereof be more readily identified. Various other modifications will be apparent to those skilled in the art. Accordingly, all such modifications that come within the scope of the appended claims are seen to be within the true spirit and scope of the present invention.

What is claimed is:

1. A polishing pad conditioner, comprising:

a housing;

a conditioning head having an abrasive disk for conditioning a polishing pad, the conditioning head being supported for rotation at one side of said housing;

a transmission mechanism having a plurality of transmission elements coupled to said conditioning head so as to transmit a drying force to said conditioning head that rotates the head, said elements of the transmission mechanism comprising a first pulley disposed in the housing at another side thereof, a second pulley disposed in the housing at said one side thereof and coupled to said conditioning head, and a timing belt wrapped around the first pulley and the second pulley; and a sensor disposed in said housing and operative to sense the rate at which one of said elements of the transmission mechanism is driven.

2. The polishing pad conditioner according to claim 1, wherein said sensor is a rotation sensor disposed adjacent said second pulley and is operative to sense the rotational speed of the second pulley.

3. The polishing pad conditioner according to claim 2, wherein said rotation sensor is an optical sensor.

4. The polishing pad conditioner according to claim 1, and further comprising an air supply tube that delivers air under pressure to said conditioning head, and a pressure sensor operative to sense the pressure of the air in said air supply tube.

5. The polishing pad conditioner according to claim 2, and further comprising an air supply tube that delivers air under pressure to said conditioning head, and a pressure sensor operative to sense the pressure of the air in said air supply tube.

6. A polishing pad conditioner, comprising:

a housing;

a conditioning head having an abrasive disk for conditioning a polishing pad, the conditioning head being supported for vertical movement at one side of said housing;

an air pressure supply system connected to said conditioning head so as to exert pressure on said conditioning head that moves the head vertically, said air pressure supply system comprising a plurality of elements including an air supply tube extending within said housing and which delivers air under pressure to said conditioning head; and a pressure sensor operative to sense the pressure of the air in said air supply system.

7. The polishing pad conditioner according to claim 6, wherein said air pressure sensor is operatively connected to said air supply tube so as to sense the pressure of the air in said air supply tube.

8. A method of monitoring the operation of a polishing pad conditioner, comprising the steps of:

moving a conditioning head into contact with a polishing pad of a CMP apparatus;

producing pressure used to force the conditioning head against the polishing pad;

while the conditioning head is forced against the polishing pad, rotating the conditioning head by driving a transmission element coupled to the conditioning head;

sensing at least one of said pressure used to force the conditioning head against the polishing pad and the rate at which said transmission element is driven; and comparing the value of said at least one of said pressure and said rate to a corresponding value representative of a normal operation of the polishing pad conditioner.

9. The method of monitoring the operation of a polishing pad conditioner according to claim 8, wherein said transmission element is a driven pulley connected to the conditioning head, and said sensing comprises sensing the rate of rotation of said driven pulley.

10. The method of monitoring the operation of a polishing pad conditioner according to claim 9, wherein said pressure is delivered by an air supply tube connected to the conditioning head, and said sensing comprises sensing the pressure of air in said air supply tube.

* * * * *